US008439214B2

(12) United States Patent
Darr et al.

(10) Patent No.: US 8,439,214 B2
(45) Date of Patent: May 14, 2013

(54) PLASTIC CONTAINER WITH ELONGATED VERTICAL FORMATION

(75) Inventors: Richard C. Darr, Medina, OH (US); Richard A. Lovelace, Jr., Munroe Falls, OH (US); Christopher E. Kaminski, Northfield Center, OH (US); Edward V. Morgan, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 651 days.

(21) Appl. No.: 11/860,074

(22) Filed: Sep. 24, 2007

(65) Prior Publication Data

US 2008/0223816 A1 Sep. 18, 2008

Related U.S. Application Data

(63) Continuation-in-part of application No. 29/273,933, filed on Mar. 16, 2007, now Pat. No. Des. 586,224.

(51) Int. Cl.
*B65D 1/46* (2006.01)
*B65D 23/00* (2006.01)

(52) U.S. Cl.
USPC ..... 215/382; 215/375; 220/608; 220/673; 220/675

(58) Field of Classification Search ..... 215/375, 215/382, 383, 371.373, 900; 220/669, 673, 220/675, 604, 608, 623, 628, 671
See application file for complete search history.

(56) References Cited

U.S. PATENT DOCUMENTS

| | | | | | |
|---|---|---|---|---|---|
| 3,225,950 | A | * | 12/1965 | Fulcher et al. | 215/384 |
| D209,714 | S | | 12/1967 | Evans | |
| 3,536,500 | A | * | 10/1970 | Cleereman et al. | 426/130 |
| 4,023,494 | A | * | 5/1977 | Barton et al. | 102/314 |
| 4,170,622 | A | * | 10/1979 | Uhlig | 264/520 |
| 4,245,685 | A | * | 1/1981 | Nemitz et al. | 220/780 |
| 4,257,527 | A | * | 3/1981 | Snyder et al. | 220/675 |
| 4,824,787 | A | * | 4/1989 | Serkes et al. | 435/299.2 |
| 4,890,757 | A | * | 1/1990 | Robbins, III | 220/675 |
| 5,027,963 | A | * | 7/1991 | Robbins, III | 215/395 |
| 5,080,244 | A | * | 1/1992 | Yoshino | 215/375 |
| 5,123,554 | A | * | 6/1992 | Arvidson et al. | 215/12.2 |

(Continued)

FOREIGN PATENT DOCUMENTS

| | | | |
|---|---|---|---|
| DE | 2062684 | | 7/1972 |
| EP | 0324305 | B1 | 5/1992 |
| JP | 2000313465 | A * | 11/2000 |

OTHER PUBLICATIONS

International Search Report and the Written Opinion of the International Searching Authority for PCT/US2008/077369, mailed Nov. 28, 2008.

*Primary Examiner* — Sue Weaver
(74) *Attorney, Agent, or Firm* — Dykema Gossett PLLC

(57) ABSTRACT

A plastic container is disclosed comprising a base portion for supporting the container on a surface, an upper portion, and a body portion. The upper portion includes a neck and a dispensing opening. The body portion extends between the base portion and the neck, the body portion including a shoulder portion below the neck and a sidewall portion between the shoulder portion and the base portion. The body portion includes at least one elongated vertical formation that substantially extends along the sidewall portion from the base portion toward the shoulder portion, the elongated vertical portion being continuous along at least 0.60 the total height of the container.

21 Claims, 9 Drawing Sheets

U.S. PATENT DOCUMENTS

| | | | | |
|---|---|---|---|---|
| D370,178 | S | 5/1996 | Petre et al. | |
| 5,740,934 | A * | 4/1998 | Brady | 215/381 |
| D401,860 | S | 12/1998 | Mentasti Granelli | |
| D409,493 | S | 5/1999 | Waggaman et al. | |
| 5,927,499 | A * | 7/1999 | Vesborg | 206/509 |
| D417,156 | S | 11/1999 | Veyssiere | |
| D423,940 | S | 5/2000 | Chimetto | |
| D424,948 | S | 5/2000 | Ullmo | |
| 6,112,925 | A | 9/2000 | Nahill et al. | |
| D432,422 | S | 10/2000 | Del Bianco | |
| D434,332 | S * | 11/2000 | Sir | D9/680 |
| D434,664 | S | 12/2000 | Bretz et al. | |
| 6,179,142 | B1 * | 1/2001 | Hansen | 215/382 |
| 6,223,933 | B1 * | 5/2001 | Hochrainer et al. | 220/723 |
| 6,264,053 | B1 * | 7/2001 | Slat | 215/384 |
| D447,061 | S | 8/2001 | Peek | |
| D461,417 | S | 8/2002 | Jerome | |
| D463,292 | S | 9/2002 | Del Bianco | |
| D466,023 | S | 11/2002 | Eickmeier | |
| 6,598,755 | B1 * | 7/2003 | Pedulla et al. | 215/382 |
| D480,650 | S | 10/2003 | Moore et al. | |
| D481,317 | S | 10/2003 | Corker et al. | |
| D482,976 | S | 12/2003 | Melrose | |
| D487,564 | S | 3/2004 | Beck et al. | |
| D493,370 | S | 7/2004 | Kamineni et al. | |
| D504,069 | S | 4/2005 | Gross et al. | |
| D506,923 | S | 7/2005 | Zboch et al. | |
| D506,931 | S | 7/2005 | Delmotte | |
| D508,854 | S | 8/2005 | Livingston | |
| 6,929,139 | B2 | 8/2005 | Darr | |
| D510,027 | S | 9/2005 | Zboch et al. | |
| D517,864 | S | 3/2006 | Yu | |
| D521,868 | S | 5/2006 | Arima | |
| 7,051,891 | B2 * | 5/2006 | Darr et al. | 215/383 |
| D522,874 | S | 6/2006 | Livingston et al. | |
| 7,083,059 | B1 | 8/2006 | Le Guen | |
| 7,097,059 | B2 | 8/2006 | Saito et al. | |
| 7,172,087 | B1 * | 2/2007 | Axe et al. | 215/382 |
| D552,477 | S | 10/2007 | Hermel | |
| 7,802,691 | B2 * | 9/2010 | Mušalek | 215/381 |
| 2006/0289379 | A1 * | 12/2006 | Ozawa et al. | 215/382 |

* cited by examiner

PLASTIC CONTAINER WITH ELONGATED VERTICAL FORMATION

CROSS-REFERENCE TO RELATED APPLICATION

This application is a continuation-in-part of U.S. patent application Ser. No. 29/273,933 for PLASTIC CONTAINER, filed Mar. 16, 2007, now U.S. Design Pat. No. D586,224, which is incorporated herein in its entirety by reference.

TECHNICAL FIELD

The present invention relates to plastic containers, and body structures for plastic containers.

SUMMARY

According to an aspect of the invention, a plastic container is disclosed comprising a base portion for supporting the container on a surface, an upper portion, and a body portion. The upper portion includes a neck and a dispensing opening. The body portion extends between the base portion and the neck, the body portion including a shoulder portion below the neck and a sidewall portion between the shoulder portion and the base portion. The body portion includes at least one elongated vertical formation that substantially extends along the sidewall portion from the base portion to the shoulder portion.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
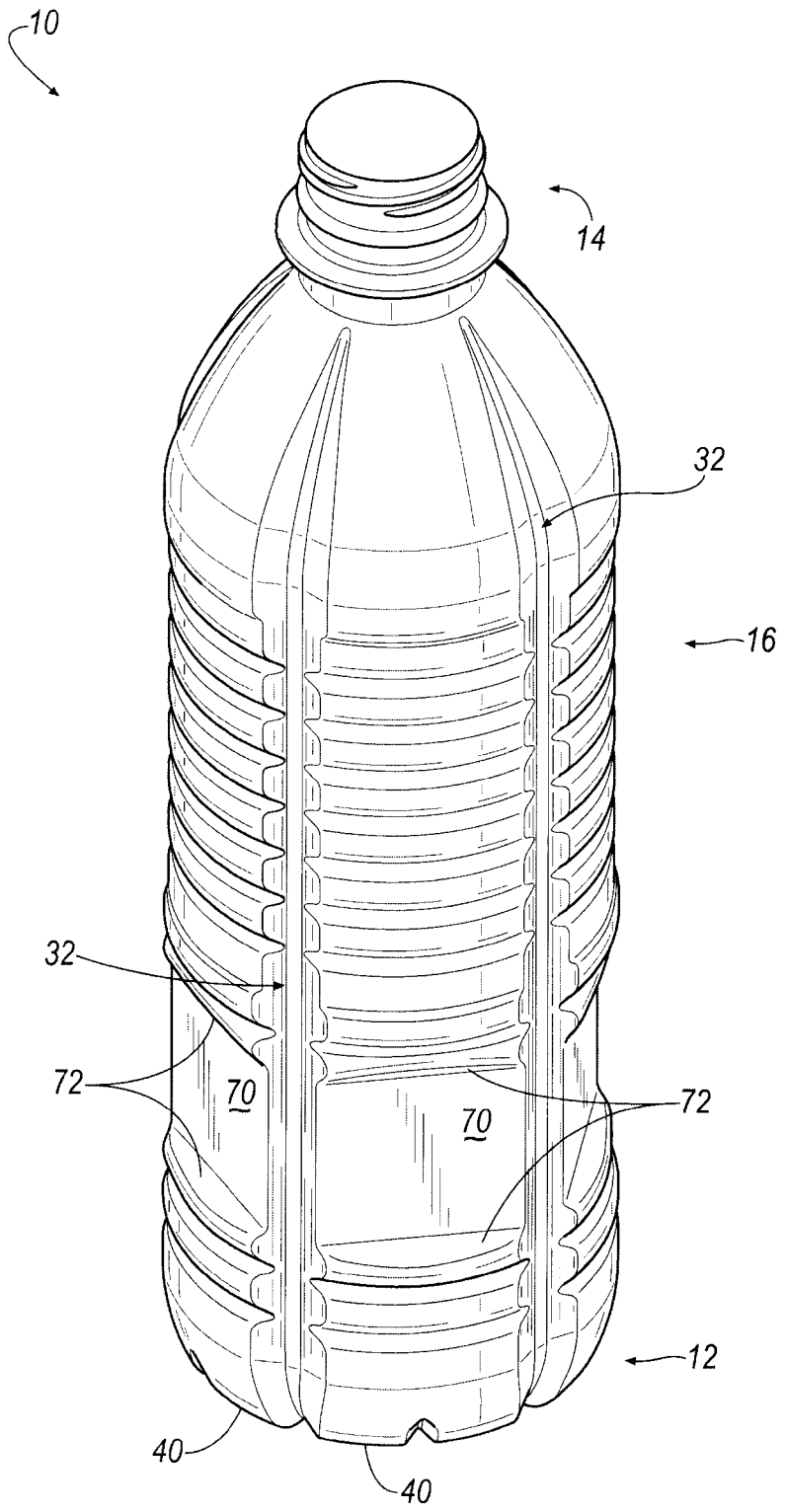
FIG. 1 generally illustrates a perspective view of a plastic container in accordance with an embodiment of the invention.

FIG. 1 generally illustrates a plastic container 10 according to an embodiment of the invention. As generally illustrated in FIGS. 1 and 2, container 10 includes a base portion 12; an upper portion 14; and a body portion 16.

While the illustrated embodiment generally depicts a "footed" base, base portion 12 is not so limited and may comprise various other forms and configurations of bases, including, without limitation, various "footed" or "champagne" style bases commonly employed with plastic containers. Among other things, base portion 12 serves to help support container 10 on a surface.

Figure 2:
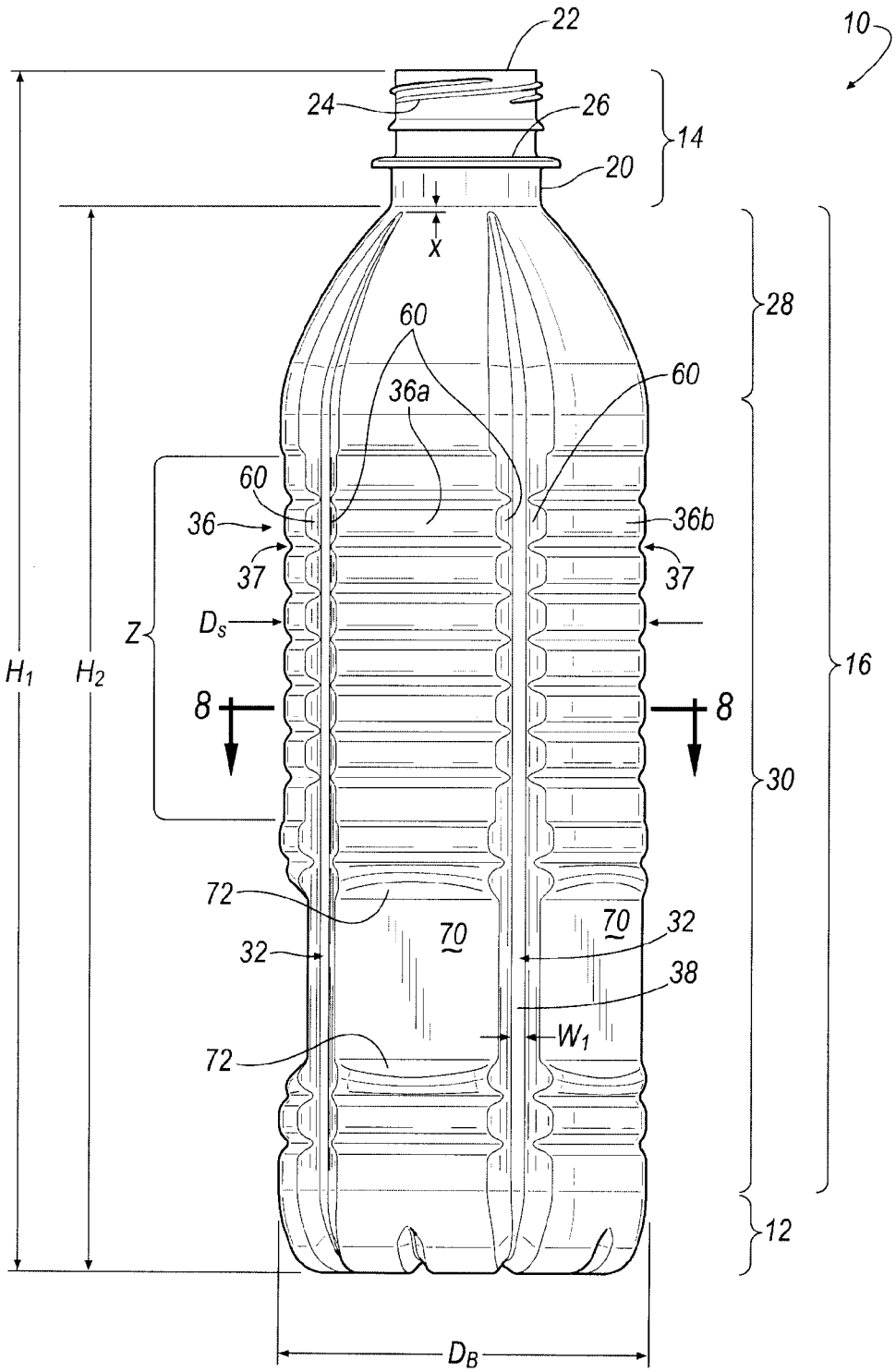
FIG. 2 generally illustrates a right side elevation view of the container shown in FIG. 1.
Figure 3:
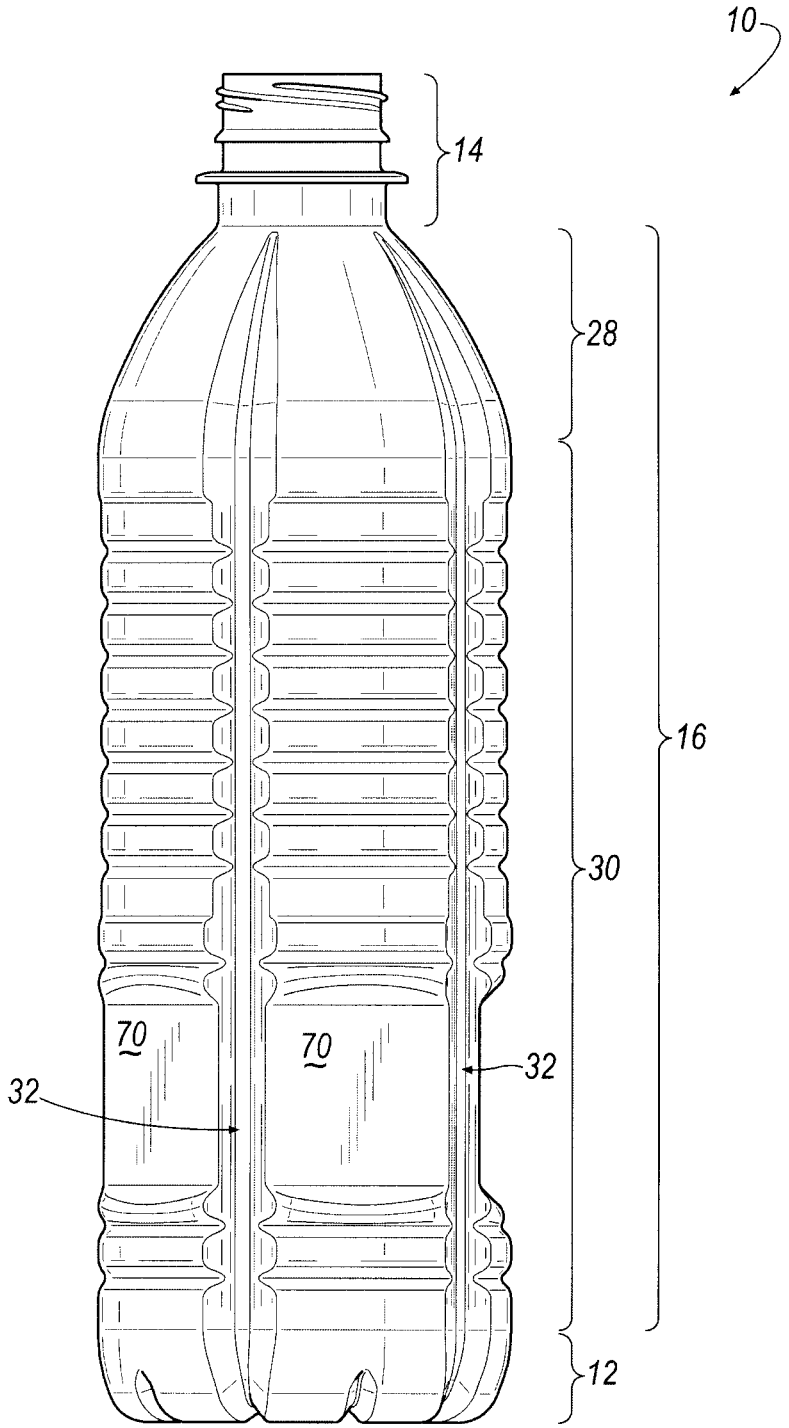
FIG. 3 generally illustrates a left side elevation view of the container shown in FIG. 1.
Figure 4:
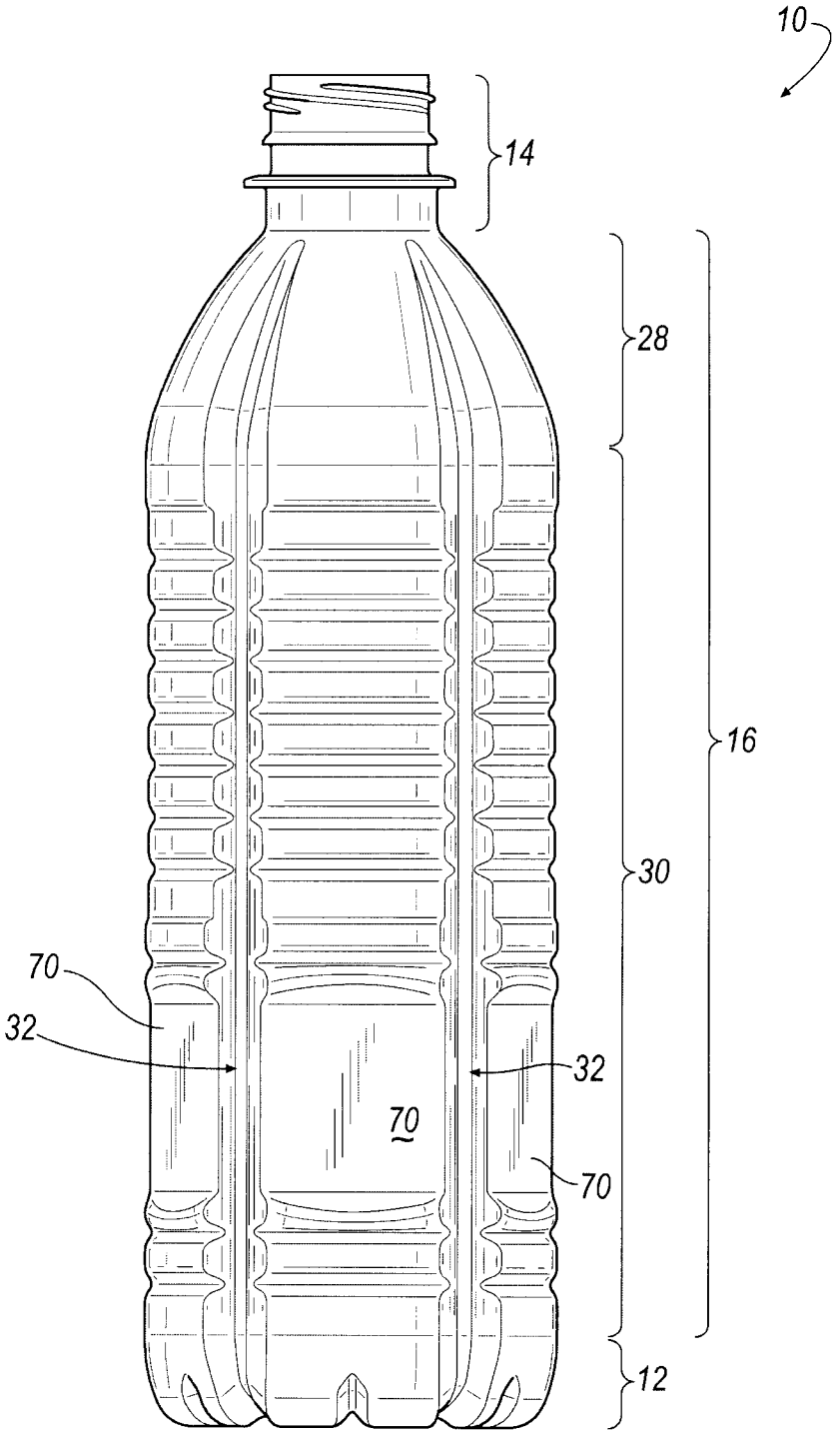
FIGS. 4 and 5 generally illustrate additional elevation views of the container shown in FIG. 1.
Figure 5:
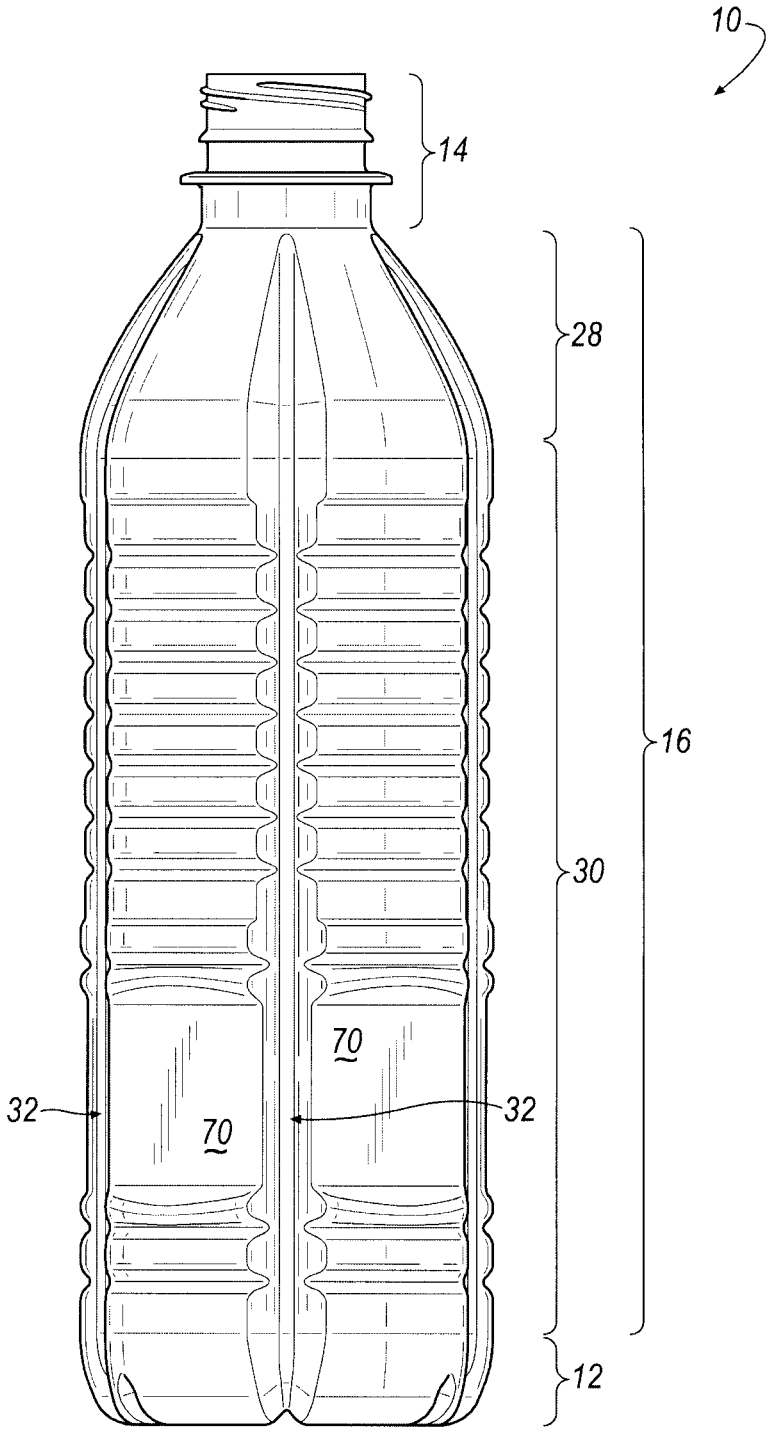

As generally illustrated in the embodiment shown in FIG. 2, upper portion 14 includes a neck 20 and a dispensing opening 22. In an embodiment, container 10 may also include threads 24 or other formations for receiving a closure and/or may include a continuous or non-continuous support flange 26.

In the illustrated embodiment, body portion 16 extends between base portion 12 and neck 20. Body portion 16 includes a shoulder portion 28 and a sidewall portion 30. Shoulder portion 28 is positioned below neck 20 and may curve or taper radially inwardly as the shoulder portion approaches neck 20. Sidewall portion 30 is positioned between shoulder portion 28 and base portion 12. It is noted that while the body portion 16 may be cylindrical, the invention is not limited to container body portions having purely cylindrical configurations and may, for instance, include containers that include portions that taper in or provide recesses for accommodating portions of the hand of a user.

Body portion 16 also includes at least one elongated vertical formation 32. An elongated vertical formation is "vertical" in that it generally extends upwardly or in a vertical direction along sidewall portion 30 from base portion 12 toward (or in the direction of) shoulder portion 28. In an embodiment, the elongated vertical formation 32 is substantially straight (i.e., without significant turns or bends) in a vertical direction along a portion or substantially of its length along the sidewall portion 30. For other embodiments, the elongated vertical formation 32 may, however, include one or more turns or bends (including those that may not be vertical for a segment) while overall the formation 32 continues to extend in a generally upward direction along the sidewall portion 30.

Further, in an embodiment, elongated vertical formation 32 is continuous along at least 0.60 of the total height of the container. By way of example, without limitation, a 10 oz. container according to an embodiment of the invention may include an elongated vertical formation 32 that is continuous along at least 0.62, or even 0.68, the total height of the container. Similarly, and also without limitation, a 14 oz. container according to an embodiment of the invention may include an elongated vertical formation 32 that is continuous along at least 0.72 the total height of the container. Moreover, for some embodiments, the elongated vertical formation 32 is continuous from the base portion into an upper region of the sidewall portion 30 of the container 10. The upper region of the sidewall portion 30 is typically a region that is in the upper one-half of the sidewall portion 30, which generally coincides with the upper one-half of the container. For some embodiments, the upper region will be a portion of the sidewall that overlaps the upper one-third of the container. In an embodiment, a plurality of elongated vertical formations 32, for example, three to six, may each extend along the sidewall portion 30 into the base portion 12, into the shoulder portion 28, or into both the base portion 12 and the shoulder portion 28. Moreover, for some embodiments, the elongated vertical formation 32 is continuous along its entire length.

Figure 6:
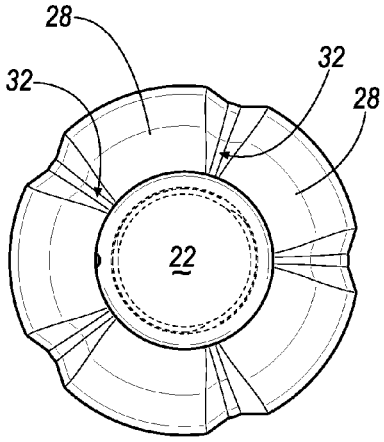
FIG. 6 generally illustrates a top plan view of a container as generally shown in FIG. 1.

Moreover, for some embodiments, one or more elongated vertical formations 32 may extend into shoulder portion 28 up to or adjacent neck 20. FIG. 6 depicts a top plan view of an embodiment of a container 10 in which a plurality of elongated vertical formations 32 extend substantially into the shoulder portion 28, and extend up to a position at or adjacent to neck 20. In an embodiment, one or more elongated vertical formations extends up to or to within a small distance X from the lower segment of neck 20. For some embodiments, distance X may, for example be within 0.10 inches of neck 20. For other embodiments, distance X may be as large as 1.0 inches or more. Without limitation, in the embodiment illustrated in FIG. 2, which may represent a 500 ml container, the elongated vertical formation may have a vertical length that is equal to or exceeds 7 inches. For some embodiments of the invention, one or more elongated vertical formations may have a vertical length that is more than 0.75 the total or overall height of the container 10, and for some embodiments may have a vertical length that is equal to or greater than 0.80, or even 0.84 of the total or overall height of the container. Further, some embodiments, include three, four, or more elongated vertical formations 32 that begin within a portion of base portion 12 and extend, at least substantially continuously, up into a portion of shoulder portion 28.

Elongated vertical formation 32 may comprise a strip 38 (such as the central substantially flat or slightly curved strip generally illustrated in FIGS. 1-5) or may comprise other formations, including a rib or a groove. Further, for some embodiments, some or all such formations may be directed inwardly with respect to the surface of the container, for others, some or all formations may be directed outwardly. In an embodiment, elongated formation 32 has a substantially constant width $W_1$ for at least a portion of the formation 32 through a central portion of the container. For example, without limitation, elongated formation 32 may have a substantially constant width $W_1$ for a segment that extends from at or about the base portion 12 to at or about the shoulder portion 28. For some embodiments, portions of an elongated vertical formation that extend upwardly into shoulder portion 28 may be configured to taper-in, at least to some degree, as the elongated vertical formation 32 extends toward neck 20. With other embodiments, portions of the elongated vertical formation 32 may include segments of the formation that are consistent (i.e., have a substantially consistent width and depth) and may include other portions (of the same formation) that taper in, taper out, and/or have a variable depth. Additionally, in an embodiment of the invention, a container may include a body portion and/or shoulder portion that include one or more elongated vertical formations, the formations configured such that the total outer surface area associated with the elongated vertical formations in such portions of the container account for from about 0.01 to about 0.52 of the total external surface area of the body portion and/or shoulder portion. Without limitation, in a particular embodiment the aforementioned surface area ratio may be found to be about 0.20±0.10. Moreover, embodiments of containers constructed in accordance with the present invention can provide a top load capacity of as much as about 3 pounds or more.

With reference to FIG. 2, an embodiment of a 500 ml container is generally illustrated. While the invention is not so limited to a container of that size, or with such a configuration, by way of example, the overall height of the container $H_1$ may be 8.250±1 inches, the height from the bottom of the base portion 12 to upper portion 14 $H_2$ may be 7.36±1 inches, the diameter of the container (taken at the base portion) $D_B$ may be 2.56±0.45 inches, and the diameter of the container (taken at a sidewall portion 30) $D_S$ may be 2.50±0.45 inches. In an embodiment, an unfilled 500 ml container that is configured in accordance with the teachings of the present invention, for example as shown in FIG. 1, may weigh 12.0 g or less. In another embodiment, such a container may weigh 10.0 g. or less.

Figure 7:
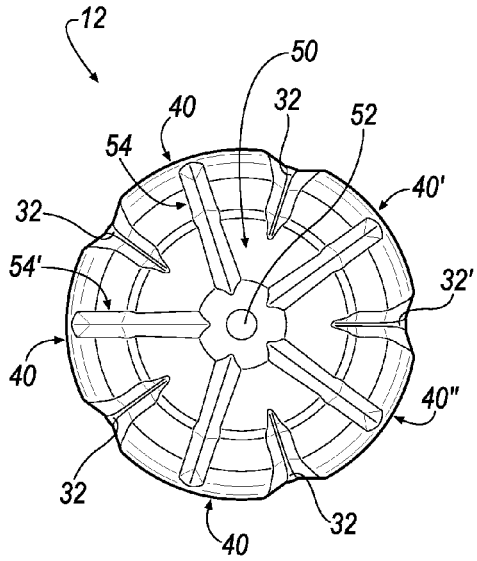
FIG. 7 generally illustrated a bottom view of a container as generally shown in FIG. 1.

As previously noted, some embodiments may include a plurality of feet. FIG. 7 generally illustrates a bottom plan view of a base portion 12 for a footed base according to an embodiment of the invention. The illustrated base portion 12 is shown with a plurality of feet 40 and a plurality of elongated vertical formations 32 extending from around a bottom portion of sidewall portion 30 and into the base portion 12. In an embodiment, the elongated vertical formation 32 extends into the base portion 12 and at least partially separates adjacent feet 40. For example, in the illustrated embodiment, elongated vertical formation 32' generally crosses or bisects adjacent feet 40' and 40". Without limitation, in an embodiment, base portion 12 includes a plurality of feet, and a plurality of elongated vertical formations 32 are provided such that one elongated vertical formation 32 extends into the base portion 12 and separates each pairing of adjacent feet 40 (e.g., 40' and 40"). For example, as generally illustrated (see, e.g., FIG. 7), the base portion 12 may include five feet 40, and the body portion 16 may include five elongated vertical formations 32, such that each of the five elongated vertical formations 32 extends into the base portion 12 and separates a different pairing of adjacent feet 40. In other embodiments, the elongated vertical formation 32 may instead be configured so that one or more of the elongated vertical formations 32 run between adjacent feet 40 without traversing or bisecting one or more feet.

Base portion 12 may include a central portion 50. For example, as generally illustrated in FIG. 7, if desired for some embodiments, elongated vertical formations 32 may extend from sidewall portion 30 into the central portion 50. Base portion 12 may further include a central formation 52, such as a flat portion or a central convex portion that extends upwardly or downwardly. In an embodiment, base portion 12 includes at least one radially-extending reinforcement formation 54, and at least one elongated vertical formation 32 extends radially into the base portion 12. As generally shown in FIG. 7, for an embodiment of the invention, the radially-extending reinforcement formation 54 may extend substantially from an outer extremity of the base portion into central portion 50. Moreover, in an embodiment, an elongated vertical formation (e.g., 32') may be configured to be in diametrical alignment with the at least one radially-extending reinforcement formation (e.g., 54').

In embodiments of the invention, sidewall portion 30 may include at least one transverse formation 36. Transverse formation 36 may be considered "transverse" in that, if such formation were continued in an uninterrupted manner around the periphery of container 10, the formation would, actually or theoretically, run crosswise or across at least some of the elongated vertical formations 32.

Transverse formation 36 may, for example, comprise, one or more transverse rib segments. In an embodiment, a transverse formation 36 may comprise a plurality of generally parallel horizontal rib segments (e.g., 36a, 36b) that together generally circumscribe or encircle container 10. Such rib segments may extend radially outwardly from the sidewall 30 of container 10 and may be separated by grooves 37. If desired, for example, as generally illustrated in FIGS. 1-5, transverse formation 36 may extend substantially around the circumference of a portion of sidewall 30 with portions thereof separated by (and substantially perpendicular to) one or more elongated vertical formations 32 that extend along the sidewall 30 from base portion 12 to shoulder portion 28. By way of example, without limitation, sidewall portion 30 may include a plurality of transverse formations 36 which are traversed by a plurality of elongated vertical formations 32.

In an embodiment, the transverse formation 36 may include one or more segments (e.g., segments 36*a*, 36*b*). Further, for some embodiments, such one or more segments may include a sloped end portion 60 (see e.g., FIG. 2) that extends radially inwardly. The sloped end portion 60 of one or more transverse formations 36 may connect to a side of an adjacent elongated vertical formation 32. As generally illustrated, in an embodiment body portion 16 may include a transverse formation in the form of a transverse rib that has at least a first and second transverse segments (e.g., 36*a*, 36*b*), such that the first and second transverse segments are traversed or separated by an elongated vertical formation 32, and the first and second transverse segments may each include a sloped end portion that connects with or to a different side of the elongated vertical formation 32.

Figure 8:
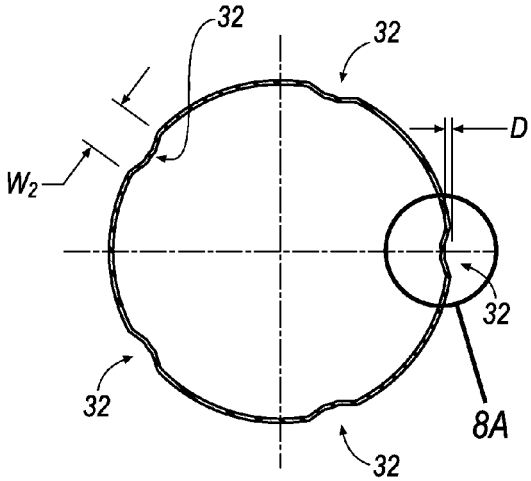
FIG. 8 generally illustrates a section view taken along lines 8-8 of FIG. 2.
Figure 8A:
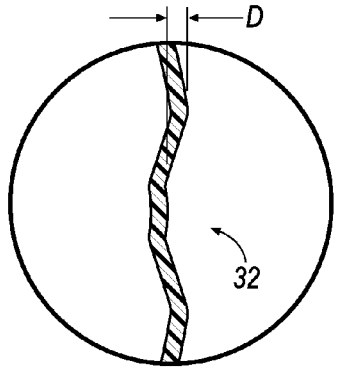
FIG. 8A is a partial view enlargement of FIG. 8.
Figure 9:
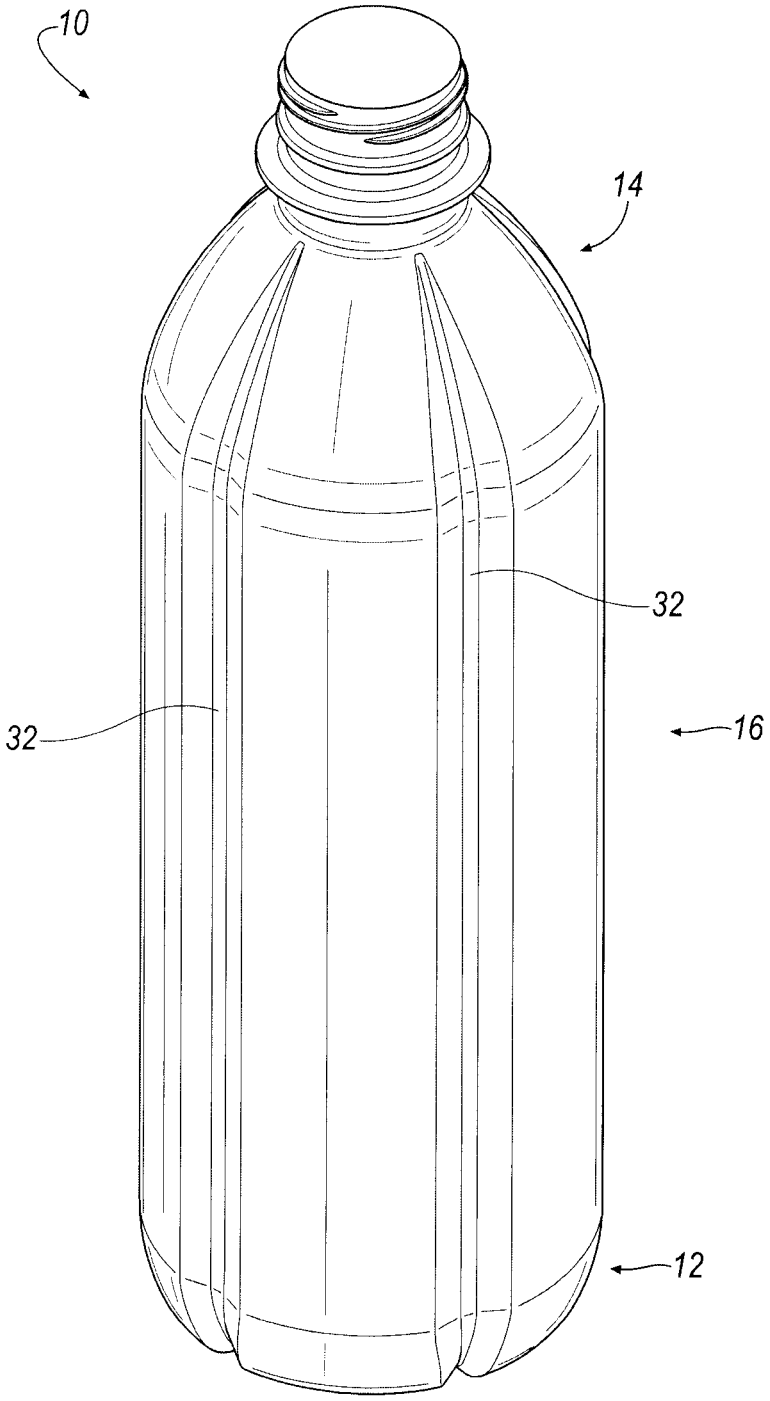
FIG. 9 generally illustrates a perspective view of a plastic container in accordance with another embodiment of the invention.
Figure 10:
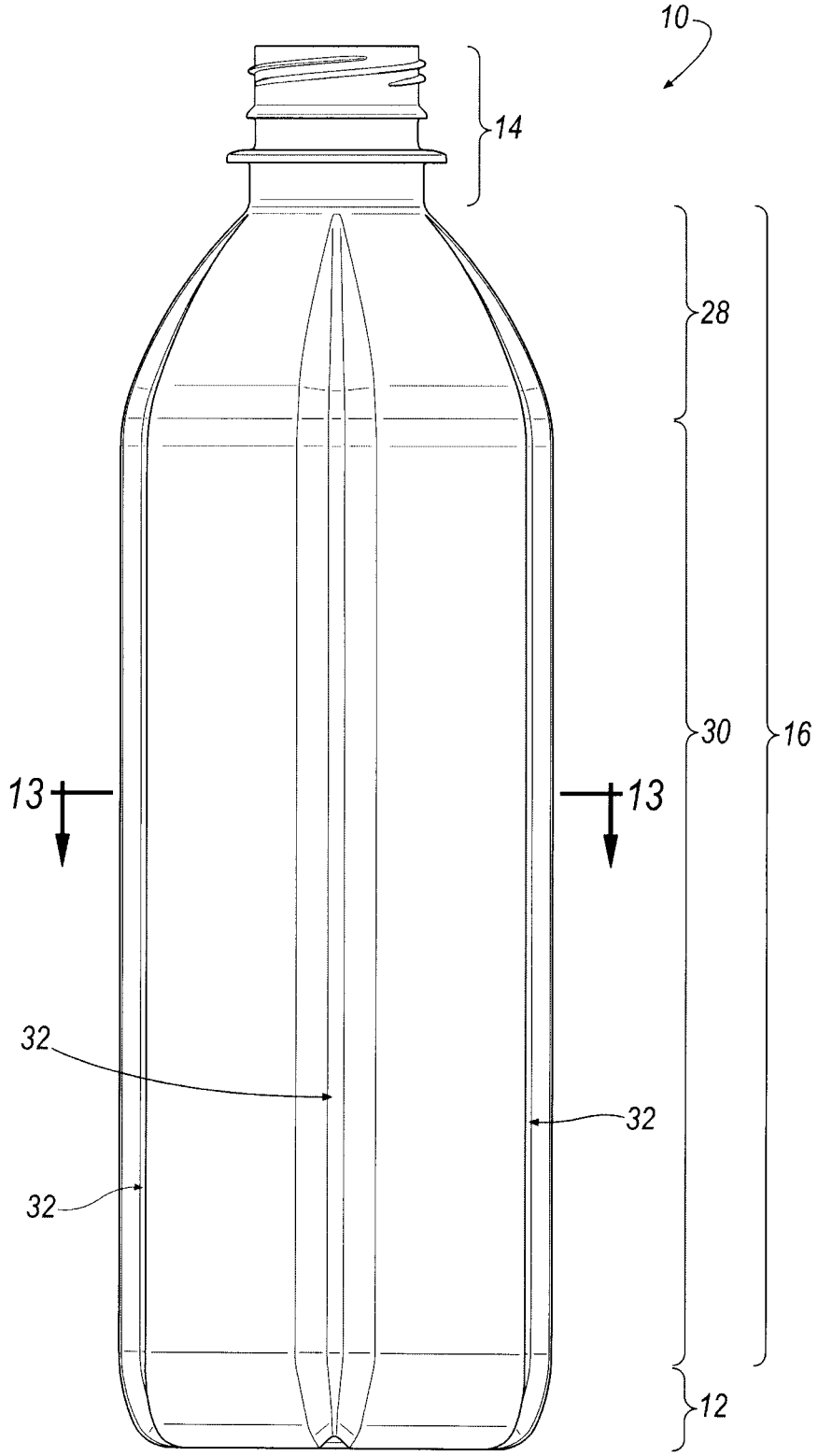
FIG. 10. generally illustrates a right side elevation view of the container shown in FIG. 9.
Figure 11:
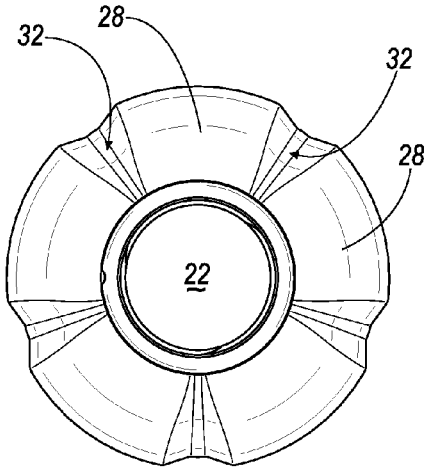
FIG. 11 generally illustrates a top plan view of the container shown in FIG. 9.
Figure 12:
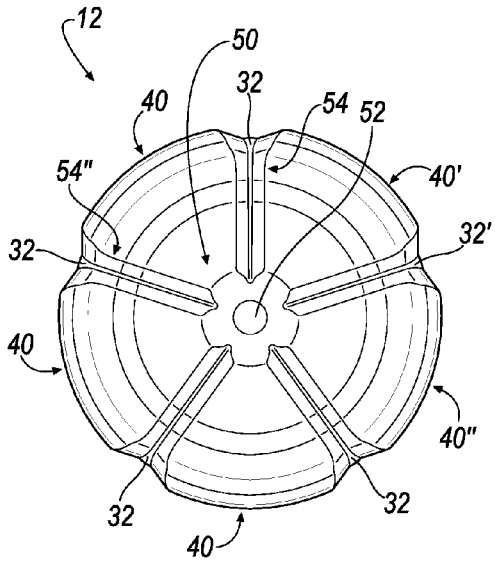
FIG. 12 generally illustrates a bottom view of the container shown in FIG. 9.
Figure 13:
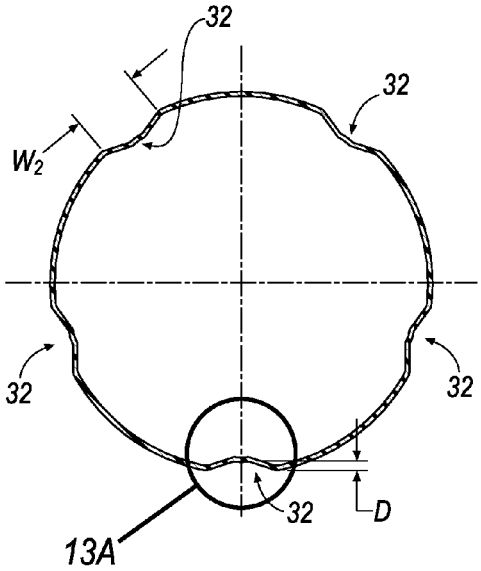
FIG. 13 generally illustrates a section view taken along lines 13-13 of FIG. 10.
Figure 13A:
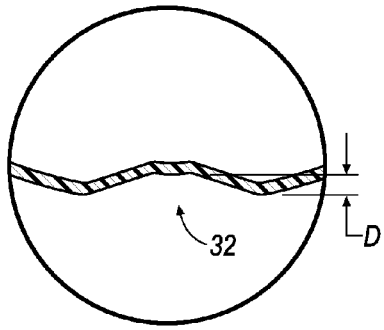
FIG. 13A is a partial view enlargement of FIG. 13.

Viewed in cross-section, the elongated vertical formation 32 may form a U-shaped or V-shaped portion. FIG. 8 illustrates a cross-sectional view taken along lines 8-8 of FIG. 2, which shows the cross-section of the elongated vertical portion having a shallow or drawn out U-shaped form. By way of example and without limitation, for a 500 ml container, the depth D of the elongated vertical formation 32 may be 0.5±0.2 inches, and the width $W_2$ may be 0.370±0.2 inches. The elongated vertical formations associated with the invention are, however, not limited to the foregoing dimensions, and such forms and dimensions may be varied in connection with containers of differing sizes and configurations.

Another embodiment of a container including features of the present invention is illustrated in FIGS. 9-13. Like element numbers are substantially consistent with those described in connection with the preceding embodiments of the invention. The illustrated container is similar to the container shown in FIG. 1. However, among other things, the embodiment illustrated in FIG. 9 does not include transverse formations. Of course, the embodiment is not limited to that shown, and various configurations with other transverse formations, e.g., ribs, may be provided and remain within the spirit and scope of the present invention. Moreover, as illustrated in connection with FIG. 12, in an embodiment, each of the elongated vertical formations 32 may continue from the sidewall portion 30 into base portion 12, and further may continue onto central portion 50 and, if desired, into or adjacent central formation 52. For example, as shown, formations 32 may come into contact with a central formation 52, such as a flat portion or a central convex portion that extends upwardly or downwardly.

Referring again generally to FIGS. 1-5, container 10 may include one or more substantially flat portions 70. For many embodiments, a label can be applied around or about a portion of the sidewall of the container, such as the generally illustrated label zone Z shown in FIG. 2. The associated label may be of a conventional type, and for some embodiments may include a wrap-around label.

For some embodiments, such as the illustrated embodiment, "substantially flat" means substantially linear when viewed in cross-section. For other embodiments, "substantially flat" may mean having some small degree of curvature, i.e., a degree of curvature that is at least visually perceptibly different from the degree of curvature associated with the peripheral curvature associated with adjacent portions of the sidewall portion 30 above and/or below the substantially flat portion 70. The substantially flat portion or portions 70 may be configured to facilitate gripping and/or may be used, in part, as a label surface. Further, the inclusion of one or more substantially flat portions 70 may create one or more top and/or bottom ledges 72, for example, as generally illustrated in FIG. 1. While the substantially flat portion or portions 70 may be positioned at various vertical heights in the sidewall portion 30, in an embodiment, the substantially flat portions 70 are positioned vertically closer to base portion 12 than to shoulder portion 28. Also, for some embodiments, the number of elongated vertical formations 32 may equal the number of flat portions 70.

The container is not necessarily limited to a specific material, and those of skill in the art will recognize that containers in accordance with the teachings of the invention may be comprised from various plastic materials. By way of example, without limitation, containers in accordance with various embodiments of the invention may be comprised of a biaxially-oriented polyethylene terephthalate (PET), polypropylene (PP), high-density polyethylene (HDPE), recycled polyesters and polyolefin resins, and bio resins.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A plastic container, comprising:

a base portion for supporting the container on a surface, the base portion including a plurality of feet;

an upper portion, the upper portion including a neck and a dispensing opening; and a body portion that extends between the base portion and the neck, the body portion including a shoulder portion below the neck and a sidewall portion between the shoulder portion and the base portion;

wherein the body portion includes a plurality of elongated vertical formations along the sidewall portion that extend from in the base portion toward the shoulder portion and at least partially separate outer portions of adjacent feet, the plurality of elongated vertical formations being continuous and uninterrupted transversely along at least 0.60 the total height of the container, the sidewall portion includes a plurality of transverse formations, the plurality of elongated vertical formations traverse the plurality of transverse formations, at least one of the plurality of transverse formations traverses a plurality of the plurality of elongated vertical formations in the upper one-half of the container; and wherein the base portion includes at least one radially-extending reinforcement formation, at least one elongated vertical formation extends radially into the base portion, and the elongated vertical formation is in diametrical alignment with the at least one radially-extending reinforcement formation.

2. The container of claim 1, wherein at least one elongated vertical formation is continuous from the base portion into an upper region of the sidewall portion of the container.

3. The container of claim 1, wherein at least one of the plurality of elongated vertical formations extends along the sidewall portion from within the base portion into the shoulder portion.

4. The container of claim 3, wherein the plurality of elongated vertical formations each extend along the sidewall portion into the base portion and into the shoulder portion.

5. The container of claim 1, wherein at least one of the plurality of transverse formations is adjacent the shoulder portion.

6. The container of claim 5, wherein the transverse formation comprises a transverse rib.

7. The container of claim 5, wherein the transverse formation comprises a groove.

8. The container of claim 1, wherein a plurality of the plurality of elongated vertical formations traverse a plurality of the plurality of transverse formations in the upper one-half of the container.

9. The container of claim 1, wherein at least one of the plurality of elongated vertical formations extends to a position adjacent the neck.

10. The container of claim 9, wherein at least one of the plurality of elongated vertical formations extends up to or to within 0.1 inch of the neck.

11. The container of claim 1, wherein at least one of the plurality of elongated vertical formations comprises a strip.

12. The container of claim 1, wherein at least one of the plurality of elongated vertical formations comprises a rib.

13. The container of claim 1, wherein at least one of the plurality of elongated vertical formations has a substantially constant width between the base portion to the shoulder portion.

14. The container of claim 1, wherein the base portion includes at least five feet.

15. The container of claim 1, wherein the plurality of elongated vertical formations in the base portion form the plurality of feet.

16. The container of claim 1, wherein the plurality of elongated vertical formations are equal to the number of feet, and each elongated vertical formation extends into the base portion and separates a different pair of adjacent feet.

17. The container of claim 1, wherein the base portion includes a central portion and at least one of the plurality of elongated vertical formations extends from the shoulder portion to or into the central portion.

18. The container of claim 1, including at least one transverse rib having at least a first transverse section and a second transverse section, wherein the first and second transverse sections are traversed or separated by at least one of the plurality of elongated vertical formations, and the first and second transverse sections each include a sloped end portion that connects with a different side of the at least one of the plurality of elongated vertical formations.

19. The container of claim 1, wherein the body portion includes one or more substantially flat portions.

20. The container of claim 1, wherein an unfilled 500 ml. container weighs 12.0 grams or less.

21. The container of claim 1, wherein the vertical height of the at least one elongated vertical formation is continuous along at least 0.72 the total height of the container.

* * * * *